US007201134B2

(12) United States Patent
Guest et al.

(10) Patent No.: US 7,201,134 B2
(45) Date of Patent: Apr. 10, 2007

(54) PARALLEL ROTARY ENGINE

(76) Inventors: Aaron Matthew Guest, 514 Skyline Dr., Box 877, Cascade, ID (US) 83611; Skyler Allen Guest, 514 Skyline Dr., Box 877, Cascade, ID (US) 83611; Kittric Aaron Guest, 514 Skyline Dr., Box 877, Cascade, ID (US) 83611

( * ) Notice: Subject to any disclaimer, the term of this patent is extended or adjusted under 35 U.S.C. 154(b) by 0 days.

(21) Appl. No.: 10/906,862

(22) Filed: Mar. 9, 2005

(65) Prior Publication Data

US 2006/0201473 A1 Sep. 14, 2006

(51) Int. Cl.

| | |
|---|---|
| ***F02B 53/04*** | (2006.01) |
| ***F02B 53/00*** | (2006.01) |
| ***F01C 1/08*** | (2006.01) |
| ***F01C 1/24*** | (2006.01) |
| ***F04C 18/00*** | (2006.01) |
| ***F04C 2/00*** | (2006.01) |

(52) U.S. Cl. ..... 123/232; 123/246; 418/196; 418/191

(58) Field of Classification Search ..... 123/232, 123/246; 418/196–197, 112, 120–121, 191
See application file for complete search history.

(56) References Cited

U.S. PATENT DOCUMENTS

| | | | | | |
|---|---|---|---|---|---|
| 689,251 | A | * | 12/1901 | Unbehend | 418/196 |
| 2,088,121 | A | | 7/1937 | Swink | |
| 2,275,205 | A | | 7/1937 | Straub | |
| 2,870,752 | A | | 7/1937 | Breelle | |
| 2,920,610 | A | | 1/1960 | Breelle | |
| 3,777,723 | A | * | 12/1973 | Lundstrom et al. | 123/246 |
| 3,913,532 | A | * | 10/1975 | Frentzel et al. | 123/232 |
| 3,965,697 | A | * | 6/1976 | Beierwaltes | 418/196 |
| 2,863,425 | A | | 11/1976 | Breelle | |
| 2,927,560 | A | | 11/1976 | Breelle | |
| 3,297,006 | A | | 11/1976 | Marshal | |
| 3,435,808 | A | | 11/1976 | Allender | |
| 3,990,409 | A | | 11/1976 | Beverly | |
| 4,057,035 | A | * | 11/1977 | Su | 123/232 |
| 6,129,067 | A | | 10/2000 | Riley | |
| 6,352,420 | B1 | * | 3/2002 | Shen et al. | 418/196 |

FOREIGN PATENT DOCUMENTS

| | | | | |
|---|---|---|---|---|
| FR | 2652391 A1 | * | 3/1991 | 418/196 |
| JP | 58183823 A | * | 10/1983 | 418/191 |
| WO | WO 9102888 A1 | * | 3/1991 | 123/232 |

* cited by examiner

*Primary Examiner*—Thai-Ba Trieu
(74) *Attorney, Agent, or Firm*—David S. Nagy

(57) ABSTRACT

This rotary engine is made up of three parallel encased rotors; a male rotor, flanked by a female compression/combustion rotor, and a female separation rotor, all three coupled for synchronous rotation. The male rotor has lobes projecting from it, which mesh with complementary cavities in the female rotors during rotation. These cavities have hollows so that as the lobes mesh with them a combustion chamber is formed in the compression/combustion rotor cavities and compression zones formed in the separation rotor cavities. A passage connecting the lobe and combustion chamber provides more opportunity to convert combustion energy into rotational mechanical energy. The separation rotor serves as a pump and separates intake from exhaust gases. Passages connecting the compression zone to the combustion chamber, and that to the exhaust port, help purge residual combusted gases from the combustion chamber.

5 Claims, 10 Drawing Sheets

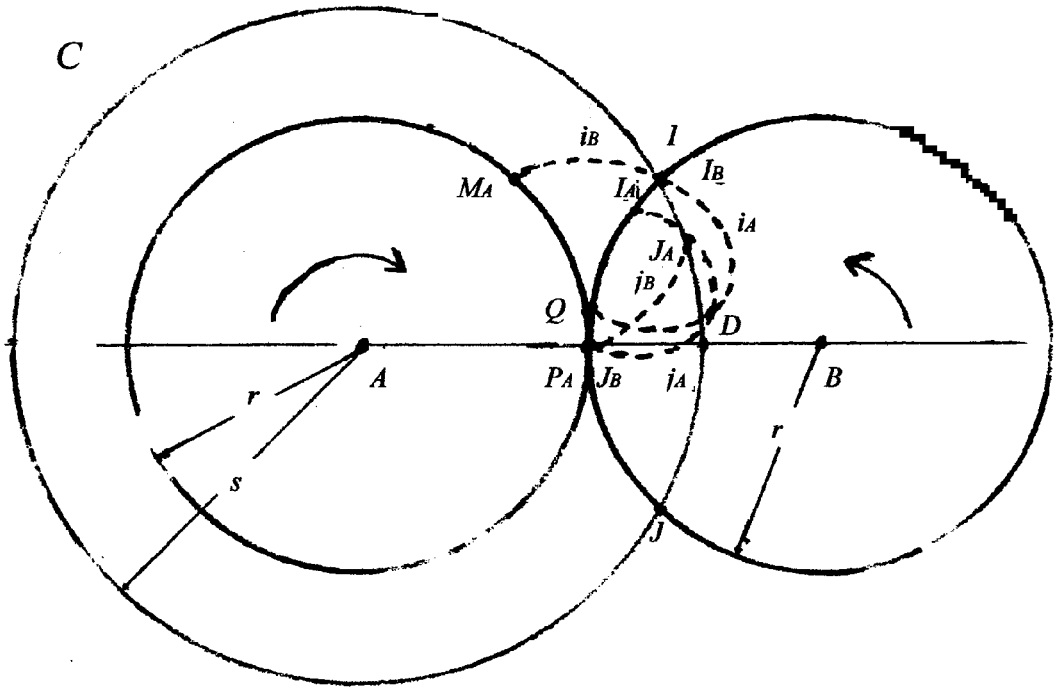
Fig. 1a
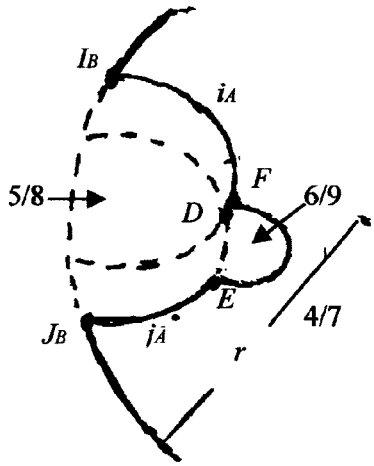
Fig. 1b
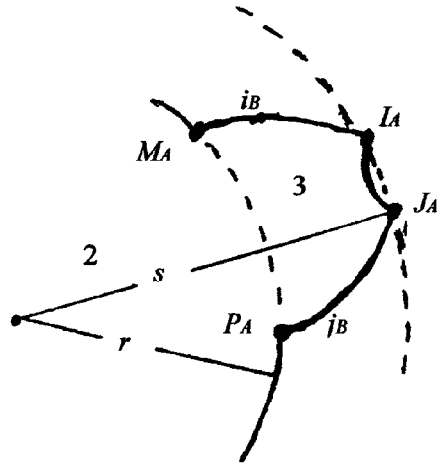
Fig. 1c
Fig. 1

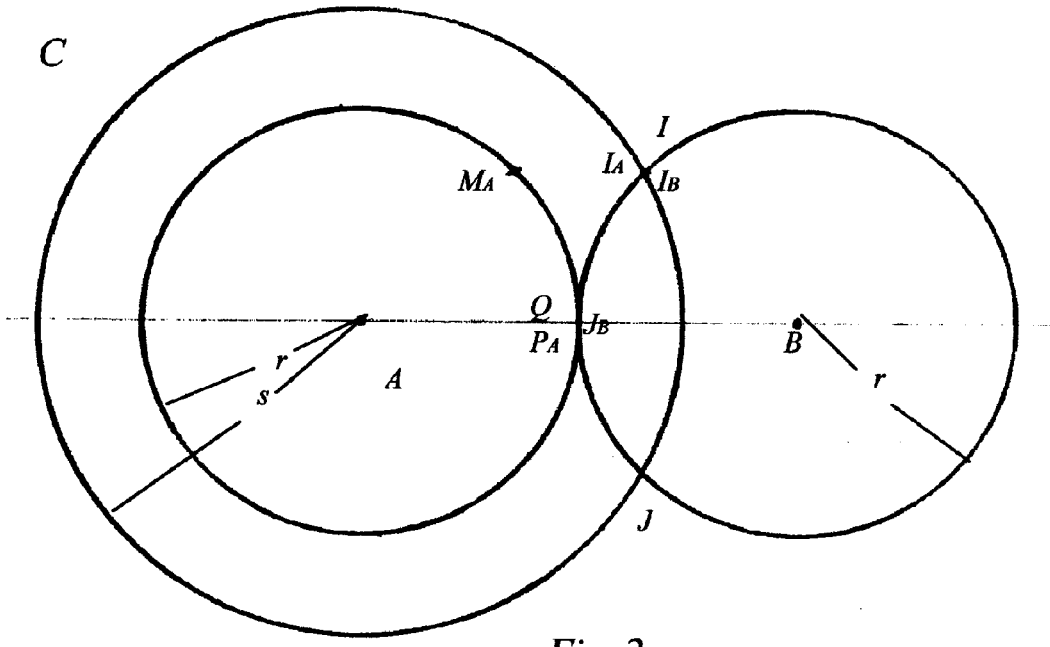
*Fig. 2a*
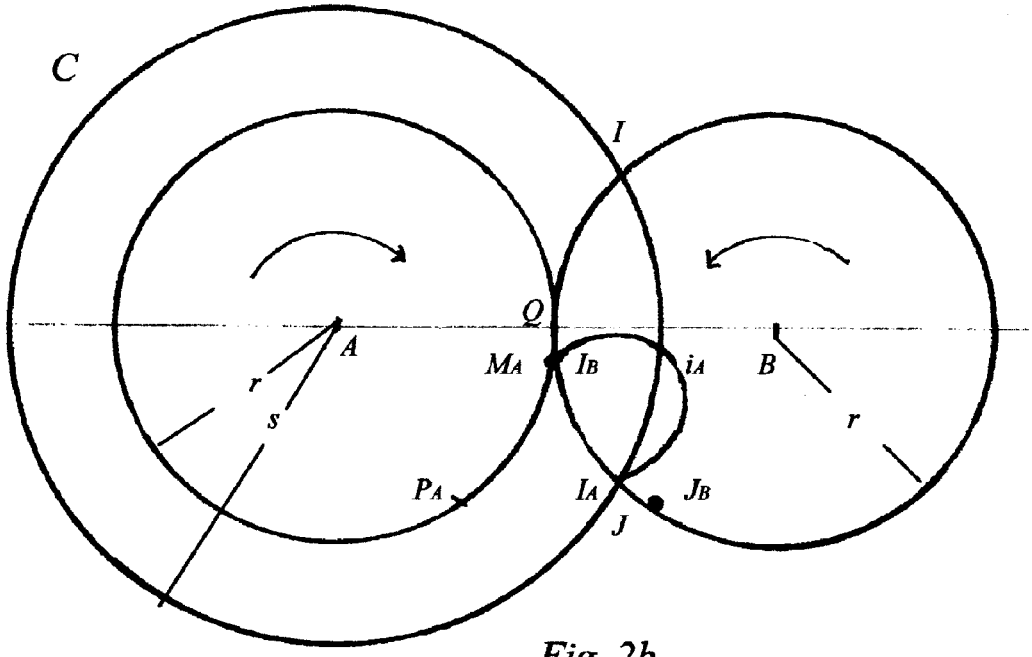
*Fig. 2b*
*Fig. 2*

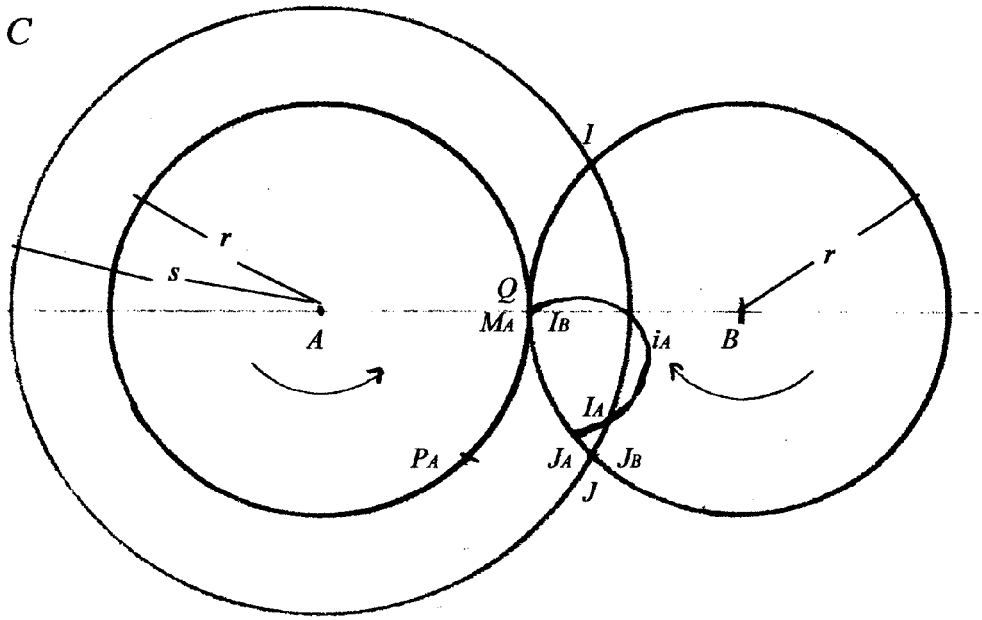
Fig. 3a
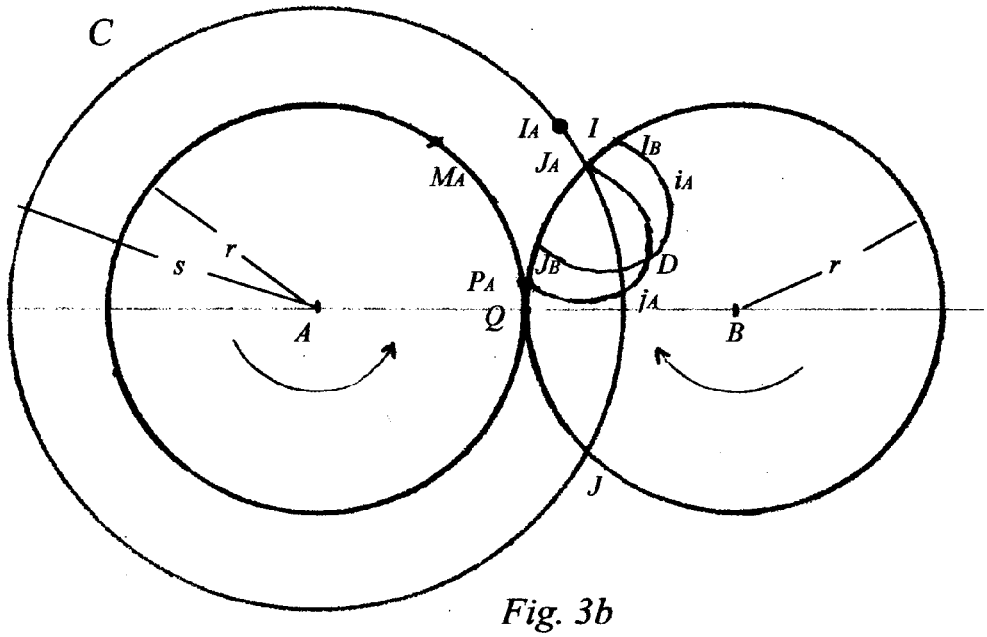
Fig. 3b
Fig. 3

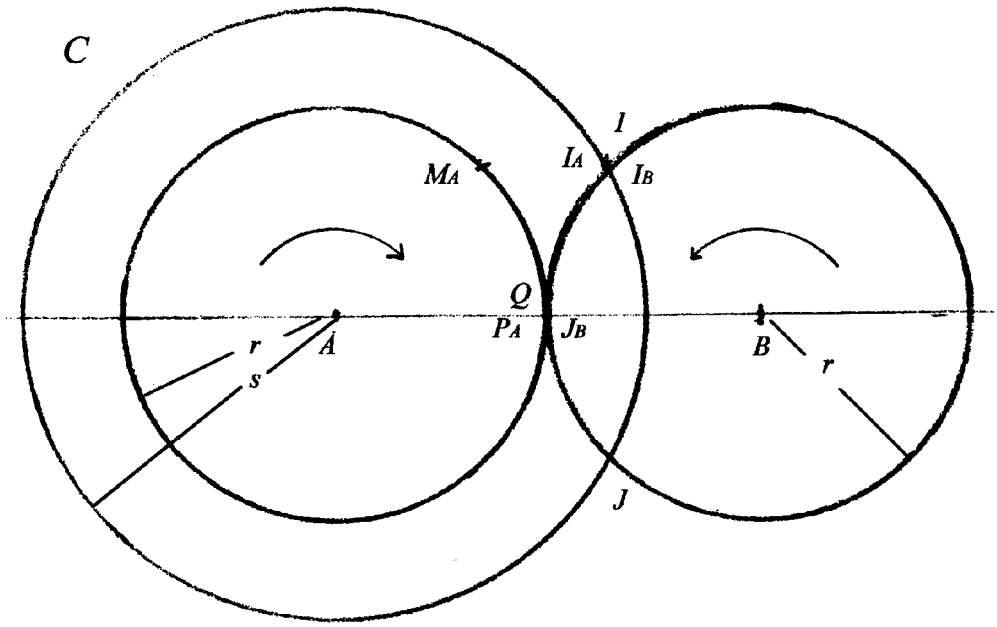
Fig. 4a
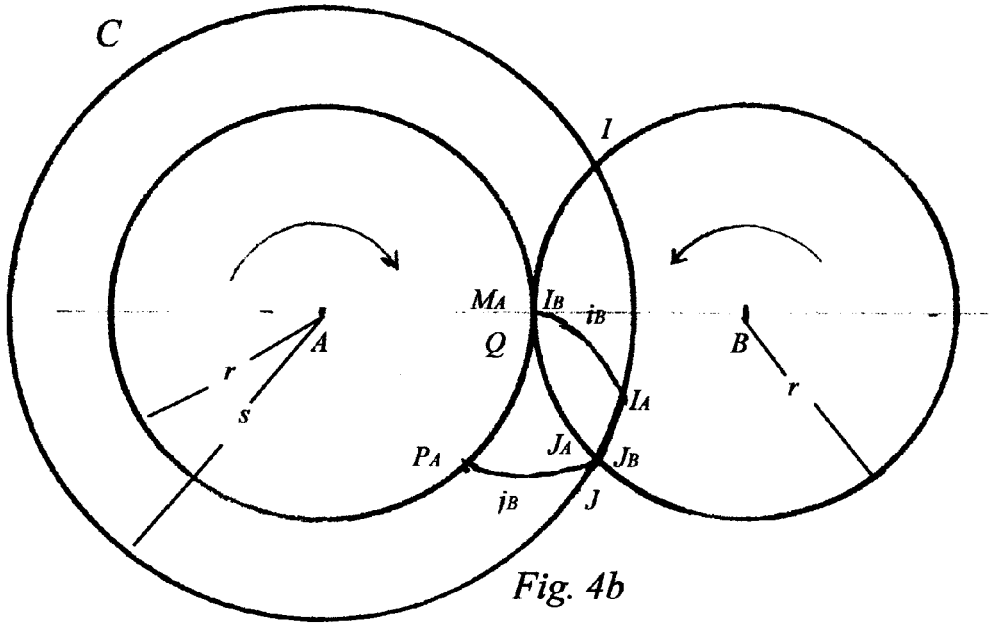
Fig. 4b
Fig. 4

PARALLEL ROTARY ENGINE

DESCRIPTION

The present invention relates generally to rotary engines and more specifically it relates to an improved parallel rotary internal combustion engine of new lobe and chamber design, and performance enhancements that can power transportation, recreational, agricultural and power equipment in a more efficient manner.

BACKGROUND OF THE INVENTION

Numerous rotary engines similar to the present invention have been provided in prior art. U.S. Pat. No. 2,920,610 Breelle and U.S. Pat. No. 3,435,808 Allender are illustrative of such prior art but, as with other prior art, have inherent flaws and limitations.

In the prior art passageways, portals, or other complicated means are relied upon to transfer the compressed gases to an area for combustion that is not geometric or positioned in such a manner as to operate efficiently.

Breelle uses a passageway to channel gases to a separate internal combustion chamber inside the combustion rotor then uses the passageway as a jet nozzle. The design greatly increases the risk of excessive pressure within the combustion chamber during combustion and there is no means to purge residual exhaust gases from the combustion chamber. The degree of complexity of design would suggest manufacture would be very challenging and costly.

Allender uses a passageway to transfer compressed gases from the compression side to the combustion side of the lobe. It appears ignition must be delayed until the lobe closes off the portal with a resultant loss of optimal compression due to the increasing volume of the combustion chamber. Another shortfall of the design is the intake and exhaust portals are open to each other during certain phases of the cycle resulting in the mixing of these gases further reducing engine efficiency.

The present invention overcomes unwanted limitations and effects of prior art in an improved basic rotary engine design so that at the time of combustion the forces applied result in a positive moment in the desired direction of each rotor.

The present invention provides performance enhancements which provide a more efficient and productive rotary engine.

The present invention provides an improved rotary design enabling gases to be compressed and ignited in a direct and efficient manner.

The present invention provides an improved design for the more efficient seal of gases.

The present invention provides an improved rotor design for the transfer of kinetic energy from combustion gases to rotational mechanical energy.

The present invention provides performance enhancements that result in the engine producing more usable energy while operating more cleanly and efficiently.

Further objectives of the invention will appear as the description proceeds.

BRIEF SUMMARY OF THE INVENTION

The present invention is a rotary engine comprised of one male rotor and two female rotors, one female rotor for compression and combustion—hereafter referred to as the "c/c rotor"—and one female rotor for separation of intake and exhaust gases. The rotors comprise a lobe and chamber that mesh to form a sub-chamber where gases are compressed. Included are a passage to provide extended communication between the lobe and combustion chamber, a passage to provide communication between the two female rotors, a passage to provide communication between the combustion chamber and exhaust port, and a wiper.

To the accomplishment of the above and related objectives, the form illustrated in the accompanying drawings represent the invention, attention being called to the fact, however, the drawings are illustrative only, and changes may be made in the specific construction illustrated and described within the scope of the appended claims.

BRIEF DESCRIPTION OF THE DRAWINGS

Numbering figures, objects, and features for reference wherein the numbers correspondingly match the numbering of the drawings from figure to figure enhances clarity. Designating the lobes and various chambers with subscripts a, b, and c clarifies the explication of the functions of the embodiments related to the phases of the cycle of operation.

FIG. 1 diagrams the cross section of the lobe and chamber design.

FIG. 2 diagrams the cross section of the chamber design construction.

FIG. 3 continues the diagram of the cross section of the chamber design construction.

FIG. 4 diagrams the cross section of the lobe design construction.

DETAILED DESCRIPTION OF THE INVENTION

Figure 5:
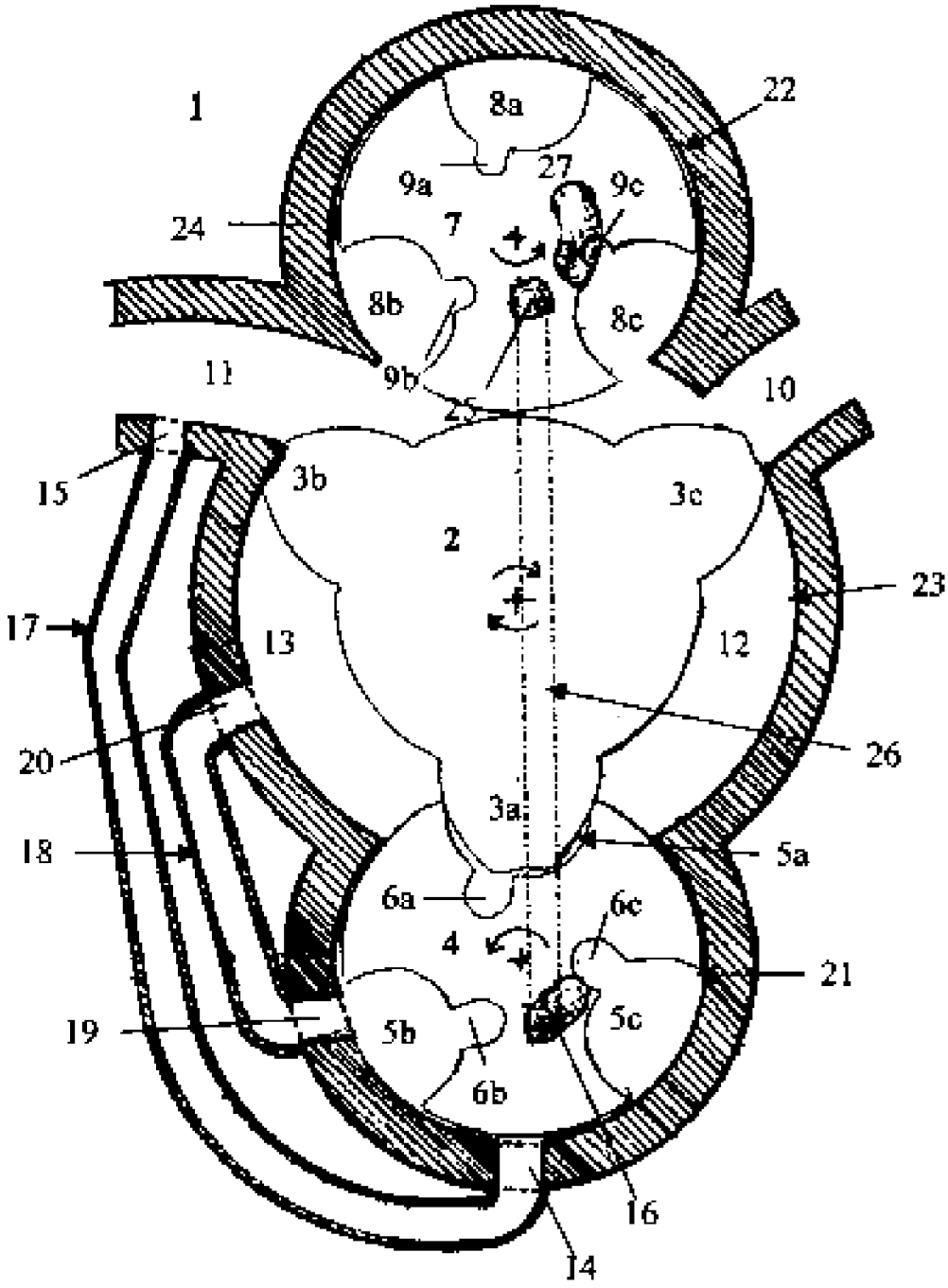
FIG. 5 diagrams the cross section of the present invention design. Just prior to maximum compression Lobe 3*a* in the second stage of its compression phase sits in position of center alignment with the centerline of the three axes of the rotors. Lobe 3*b* approaches the end of its power phase and has purged the exhaust gases out of the power chamber from the previous lobe 3*c*. Lobe 3*c* begins its first phase compression of the fuel/air mixture.

The rotary engine (1) consists of a housing (24) with a first, center main well (23), a second, compression well (21) communicating with the first side of the main well (23), and a third, separation well (22) communicating with a second side of the main well (23). The well (23) contains the main rotor (2) with three evenly spaced lobes (3) mounted on the first output shaft. The compression well (21) contains the c/c rotor (4) with three evenly spaced cavities (5) (6) mounted on the second output shaft. The separation well (22) contains the separation rotor (7) with three evenly spaced cavities (8) (9) mounted on the third output shaft. An air/fuel intake port (10) in the housing (24) communicates with the main well (23). An exhaust port (11) communicates with the main well (23) opposite from the intake port (10). A first stage compression chamber (12) in the main well (23) between the intake port (10) and the compression well (21). An expansion power chamber (13) in the main well between the compression well (21) and the exhaust port (11). A passage (18) communicates the compression well with the main well at the expansion power chamber (13) from the compression well power port (19) to the main well power port (20). A passage (17) connects the compression well at compression well relief port (14) with the exhaust port at the secondary exhaust intake port (15). A spark plug (not shown) communicates with the compression well (21) at the combustion chamber (6) to ignite the fuel. The spark plug is replaced by a fuel injector when the design parameters are used for compression ignition. Three gears (not shown) operatively connect the three output shafts together to hold the lobes of the main rotor (3) in the main well (23) in mesh with the cavities in the second (4) and third (7) rotors.

The design geometry of the lobe (3) and compression chamber (5) enable compressing air/fuel mixture directly into a combustion chamber (6) in the c/c rotor (4) thence sealing the combustion chamber with the top of the lobe at maximum compression.

Lobe and Chambers Defined:

Given two cylinders with cross section and geometry in plane C with planes A and B in C, with centers at points A and B respectively, and that are free to rotate about their center points. Point A is not equal to point B. Point Q is the midpoint between A and B (FIGS. 1 & 2). Ar is a circle with center point A with radius r, As is a circle with center point A with a radius s. Br is a circle with center point B and radius r. Points I and J define the intersection points of the circles As and Br. $I_A$ and $I_B$ are the points on circles As and Br respectively at point I. Point Q is the intersection of Ar and Br with $P_A$ and $J_B$ on circles Ar and Br respectively at Q. $M_A$ is a point on Ar where the arc $P_AM_A$ is congruent to the arc $J_BI_B$.

The compression chambers (5) (8) (FIG. 1*b*) in the secondary rotors (4) (7) respectively comprise the area defined primarily by two arcs $i_A$ and $j_A$. $i_A$ is a set of points in Br defined by $I_A$ as A and B rotate at the same rate in opposite directions (FIG. 2) until $I_A$ again intersects Br (FIG. 2*b*). A and B counter rotate until $M_A$ and $I_B$ intersect Q (FIG. 3*a*). $J_A$ on As is defined at intersection J with $M_A$ at Q. $J_B$ is also now at J. $j_A$ is the set of points in Br defined by $J_A$ as A and B continue to counter rotate until $J_A$ again intersects Br (FIG. 3*b*). $i_A$ and $j_A$ intersect at a point D in B.

With $P_A$ and $J_B$ set at Q, lobe 3 (FIG. 1*c*) of the first main rotor (2) comprise the area defined primarily by the two arcs $i_B$ and $j_B$. $i_B$ is a set of points in As defined by $I_B$, and $j_B$ is a set of points in As defined by $J_B$ as A and B rotate at the same rate in opposite directions (FIG. 4) until $I_B$ intersects Ar, which is at point $M_A$. $I_B$ intersects $M_A$ at the same time $J_B$ intersects $J_A$. The top of the lobe between $I_A$ and $J_A$ is recessed for clearance at D (FIG. 1*c*).

The combustion chamber (6) (FIG. 1*b*) in the secondary rotor (4) is expanded by creating an elliptical arc with endpoints between E and F (FIG. 1*b*). The segment EF is congruent to the segment $I_AJ_A$. E is a point on the arc $j_A$ between $J_B$ and D. F is a point on the arc $i_A$ between D and $I_B$. The chamber is shaped and sized for the desired compression. The corresponding chamber (9) in the separation rotor (7) is constructed in much the same manner as the combustion chamber. However this chamber need not be of the same size, shape, or placement since its function is to communicate the separation chamber with the transfer port (25) and vacuum relief port (27) at the proper time.

In the rectangular cartesian system of coordinates the faces of the lobe and chamber is the set of ordered pairs (x,y) where $x=2r\cos(u)-s\cos(2u)$ and $y=2r\sin(u)-s\sin(2u)$. For the face of the lobe r=s and for the face of the chamber s=ar where $1<a<2$. The engine design can vary by choosing the number of lobes and chambers desired for each rotor then setting a for the desired design. Utilizing the Law of Cosines the domain of u is readily determined to construct the rotors. In the diagrams a=1.5 for the three lobe/chamber design.

Figure 6:
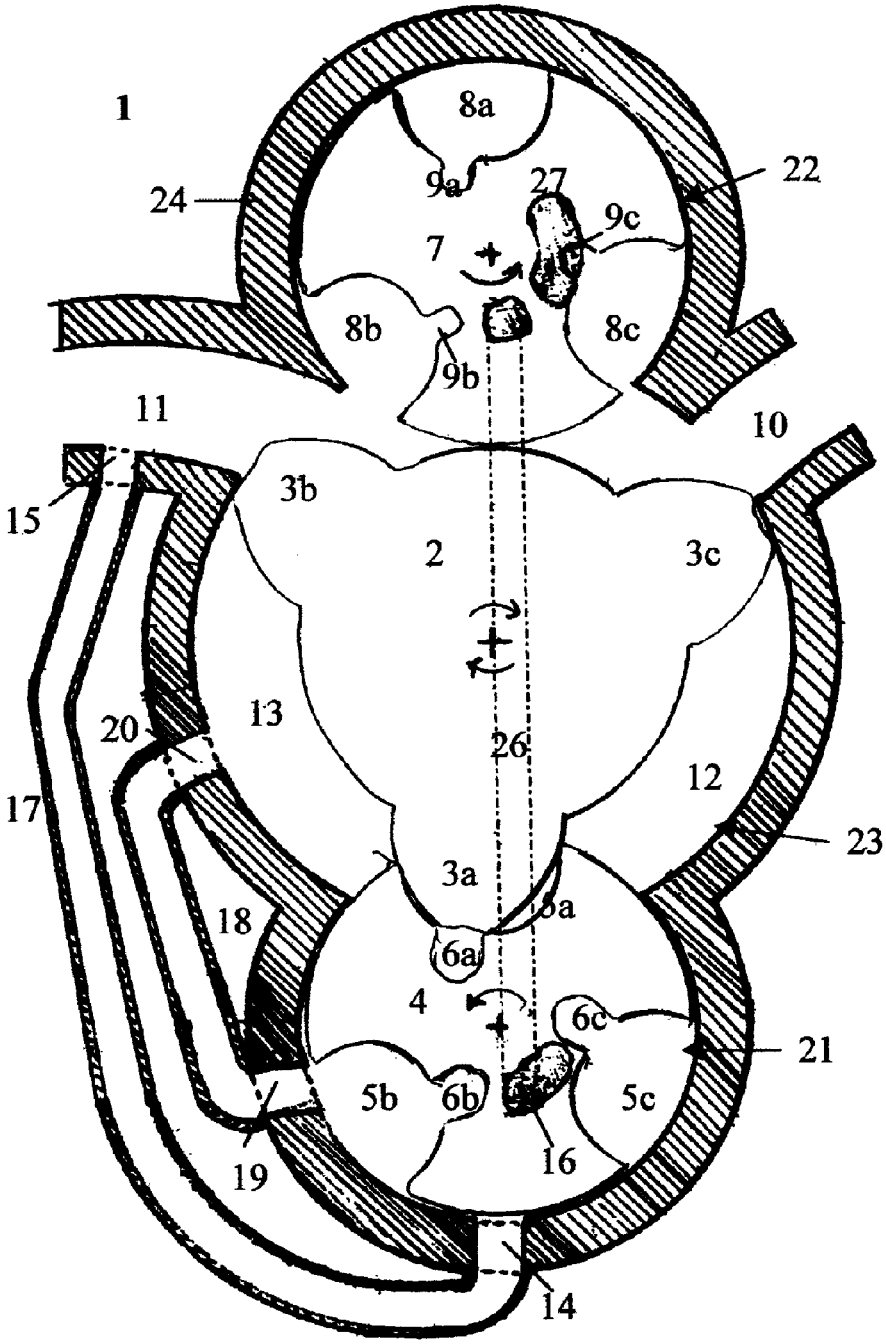
FIG. 6 diagrams the cross section of the present invention. Lobe 3*a* at maximum compression and ignition begins its power phase. The combustion chamber 6*a* is aligned and communicating with a spark plug. Lobe 3*b* ends its power phase. Lobe 3*c* continues its first phase compression of the fuel/air mixture.
Figure 7:
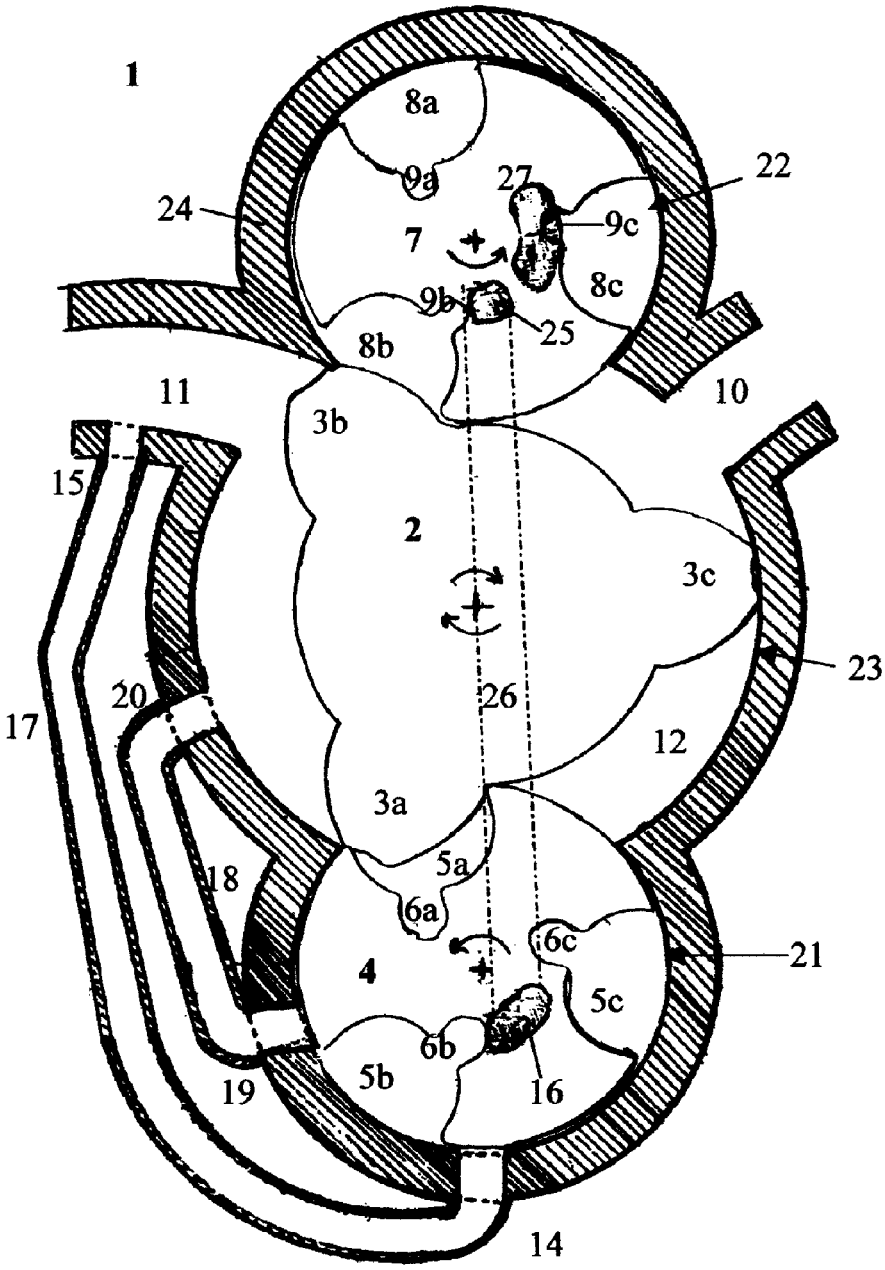
FIG. 7 diagrams the cross section of the present invention. During its primary power phase lobe 3*a* clears the power chamber of exhaust gases from the power phase of the preceding lobe 3*b*. Lobe 3*b* begins its separation phase. Lobe 3*c* in the first phase of its compression draws fuel/air for lobe 3*b*.
Figure 9:
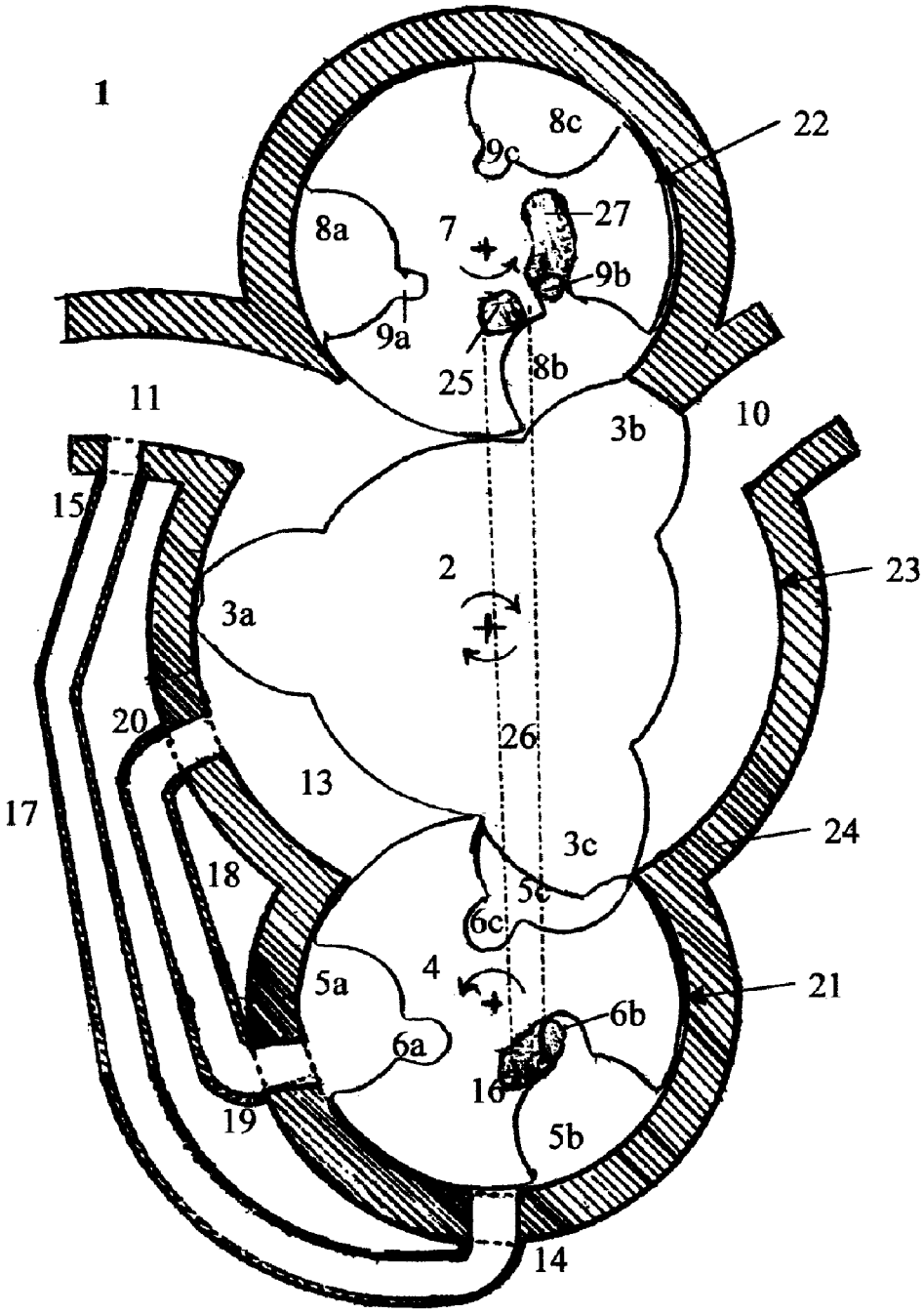
FIG. 9 diagrams the cross section of the present invention. During the secondary power phase of lobe 3*a* a passage communicates the combustion well with the power chamber. Lobe 3*b* completes its separation phase. Lobe 3*c* begins its second stage compression by sealing the lobe and compression chamber in the c/c rotor and provides maximum draw of fuel/air for the first stage compression of lobe 3*b*.

By construction as the synchronized rotors turn the lobe and compression chamber make contact at the base of the leading face of the lobe with the base of the leading wall of the compression chamber while the trailing peak of the lobe makes contact with the base of the trailing wall of the compression chamber (3*c*) (FIG. 9). The trailing peak of the lobe and the trailing wall of the compression chamber, and the base of the trailing wall of the compression chamber and the trailing face of the lobe maintain contact making a double seal (3*a*) (FIG. 5), and the base of the leading wall of the compression chamber and leading face of the lobe maintain contact (3*a*) (FIG. 5), until the combustion chamber is reached and closed by contact of the leading peak of the lobe (3*a*) (FIG. 6) with the leading wall of the compression chamber. This results in the compressed gases being forced into the combustion chamber as the leading face of the lobe and the leading wall of the compression chamber close. The combustion chamber is then sealed on either side by the two peaks of the lobe against the leading and trailing walls of the compression chamber and the two base points of the compression chamber against the leading and trailing face of the lobe (3*a*) (FIG. 6). After combustion, as the lobe and compression chamber open, the leading peak of the lobe and the leading wall of the compression chamber, and the base of the leading wall of the compression chamber and the face of the leading lobe maintain contact making a double seal. The trailing face of the lobe and the base of the trailing wall of the compression chamber maintain contact. These seal points are maintained until lobe and compression chamber separate (3*a*) (FIG. 7).

The improvements further include a lobe and combustion chamber design that at peak compression and ignition results in a positive moment arm in the desired direction of rotation of the main rotor (2) and c/c rotor (4) (FIG. 6). This is accomplished by moving the center of the opening of the combustion chamber forward of point D. The exact placement is easily adjusted to the specific design parameters desired.

The improvements further include an improved seal. As a result of the two peaks the lobe creates a double seal while operating within the center main well (23) along the housing wall of the first stage of the compression chamber (12) during the first stage compression phase (3*c*) (FIG. 7) and the housing wall of the expansion power chamber (13) during the power phase (3*a*) (FIG. 9).

The improvements further include extending the availability of expanding gases from the combustion chamber to the power chamber. After the lobe separates from the c/c rotor a passageway (18) (FIG. 9) communicates the expanding gases in the chamber (5*a*) (6*a*) in the secondary compression well (21) to the expansion power chamber (13) behind the lobe (3*a*) utilizing the kinetic energy of those expanding gases in the power phase thereby increasing engine efficiency. The compression well power port (19) and the main well power port (20) are positioned such that as the trailing base of the compression chamber enters the compression well the leading peak of the lobe is forward of the main well power port (20), the trailing peak of the lobe passes the trailing side of the main well power port (20), and the leading base of the compression chamber passes the trailing side of the compression well power port (19).

Figure 8:
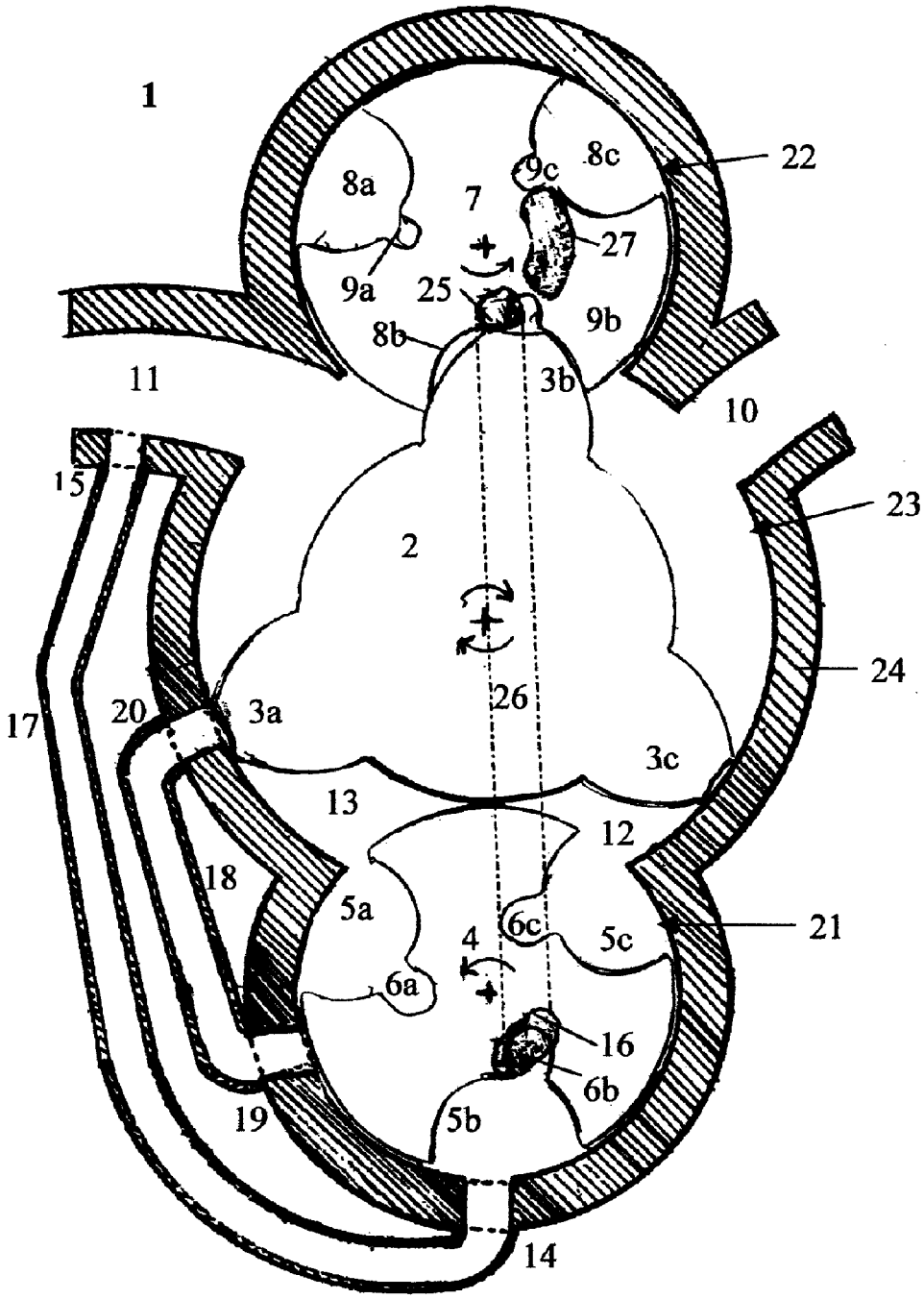
FIG. 8 diagrams the cross section of the present invention. Lobe 3*a* nears the end of its primary power phase and begins its secondary power phase as the chamber for the c/c rotor begins to seal in the secondary combustion well. Lobe 3*b* purges the gases in the separation chamber during its separation phase. Lobe 3*c* approaches the end of its first compression phase.

The improvements further include a means of reducing residual exhaust gases from entering the separation chamber (8) and clearing the exhaust gases from the compression/combustion chamber (5) (6). The separation rotor (7) in addition to separating the intake from the exhaust also serves as a pump to clear exhaust gases from the system. As the lobe (3*b*) (FIG. 7) enters the separation chamber (8*b*) the gases start to compress in the same manner as described for the c/c rotor. However, the relief chamber (9*b*) starts communicating with the separation relief port (25) in which the gases are forced through. Separation relief port (25) is communicated to secondary compression well (21) at the compression purge port (16) by a passageway (26), providing means for communicating a compression zone of the female separation rotor with a cavity of the c/c rotor to purge the cavity of the c/c rotor of residual exhaust gases. The passageway may contain a one-way check valve (not shown) to prevent any back flow of gases. The system is timed (FIG. 8) such that the purging gases are communicated through the combustion chamber (6*b*), through the compression chamber (5*b*), out the compression well relief port (14), through the secondary exhaust manifold (17), and into the main exhaust at the secondary exhaust intake port (15). The secondary exhaust intake port (15) is configured such that as the primary exhaust flows past the port a low pressure area is created which is transmitted by passage (17) to the compression well relief port (14) further aiding in clearing the combustion and compression chambers of residual gases. This compression well relief port (14) provides a means for communicating the combustion chamber of the c/c rotor with an exhaust port in order to assist the purging of combustion chamber of residual exhaust gases. As the rotors continue to rotate a vacuum is created in the expanding cavity in the separation chamber (8*b*) (FIG. 9) as the lobe (3*b*) separates from the separation chamber (8*b*). The relief chamber (9*b*) is now communicating with the vacuum relief port (27) and fresh air is being drawn into the separation chamber (8*b*). As lobe (3*b*) again approaches the separation chamber (8*b*) (FIG. 5) (FIG. 6) purging the exhaust gases from lobe (3*c*) exhaust gases are restricted from entering the separation chamber which is already occupied by the air drawn.

Figure 10:
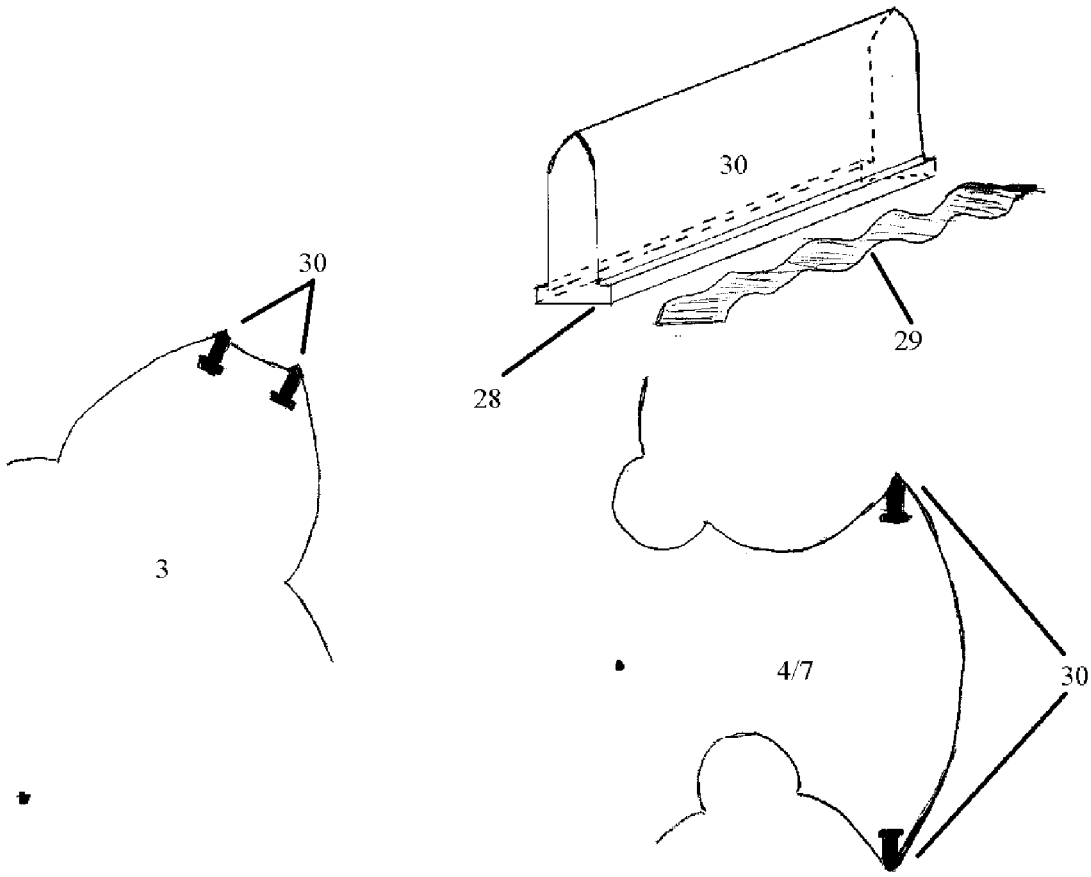
FIG. 10 diagrams the wiper and their location in the rotors.

The improvements further include a wiper and wiper groove (30) (FIG. 10) designed with a toe (28) at the base. This toe limits the distance the wiper can extrude outside the groove. The portion of the wiper that extends past the wiper groove in the rotor is profiled similar to the section of the rotor it replaces. The wiper facilitates a smooth transition alternately between the surface of the opposing rotor and the surface of the rotor housing compensating for any backlash in the timing gears and adjusting for any thermal expansion of the system. This limited range allows the wiper to maintain contact and form a seal with the opposing rotor and wall of the rotor housing during rotation while preventing the wipers from extending past the profile required for a smooth transition of the wipers between surfaces. A spring (29) under the foot of the wiper maintains an outward pressure so the wiper will maintain contact with the opposing surfaces. A wiper is located at the leading and trailing base of each compression and separation chamber and the tips of the lobes.

We claim:

1. A parallel rotary internal combustion engine comprising:

a male rotor, a female compression/combustion rotor, and a female separation rotor, all three rotors being coupled for synchronous rotation;

at least one lobe projecting from said male rotor;

at least one cavity formed in said female compression/combustion rotor and said female separation rotor, said at least one cavity being comprised of a larger main chamber and a smaller secondary chamber branching off from said main chamber;

wherein when said male rotor, said female compression/combustion rotor and said female separation rotor rotate, said at least one lobe enters into and moves through said at least one cavity;

wherein a shape of said at least one lobe is defined by a top with two distinct tips with a leading wall of said at least one lobe defined by a leading base of said at least one cavity;

wherein a tailing wall of said at least one lobe is defined by a trailing base of said at least one cavity;

wherein a shape of a leading wall of said main chamber is defined by a leading tip of said at least one lobe;

wherein a trailing wall of said main chamber is defined by a trailing tip of said at least one lobe;

wherein when, in the course of its rotation, said at least one lobe has entered into said at least one cavity with both of its said two distinct tips, said at least one lobe maintains constant contact with both the leading and trailing bases of said at least one cavity, and at least one of said two distinct lobe tips maintains contact with one of the walls of said main chamber, so that as long as both said two distinct tins arc within said at least one cavity, at least one of said two distinct tips is always in contact with a wall of said main chamber;

wherein said secondary chamber branches off from said main chamber with an opening having a width less than a width of the tips of said at least one lobe;

wherein a combustion chamber is formed in said female compression/combustion rotor; and wherein a compression zone is formed in said female separation rotor as a forward tip of said at least one lobe contacts a forward wall of said main chamber concurrent with the trailing tip of said at least one lobe contacting the tailing wall of said main chamber; and a means for igniting combustion fluids in said combustion chamber.

2. The parallel rotary internal combustion engine of claim 1, further comprising means for extending communication between said combustion chamber and an expansion power chamber, which is the volume swept by said at least one lobe past separation of said at least one lobe from said at least one cavity of said female compression/combustion rotor until entry of said at least one lobe into said at least one cavity in said female separation rotor.

3. The parallel rotary internal combustion engine of claim 1, further comprising means for communicating said compression zone of said female separation rotor with said at least one cavity of said female compression/combustion rotor purge said cavity of said female compression/combustion rotor of residual exhaust gases.

4. The parallel rotary internal combustion engine of claim 1, further comprising a means for communicating said at least one cavity of said female compression/combustion rotor with an exhaust port in order to assist the purging of said at least one cavity of said female compression/combustion rotor of residual exhaust gases.

5. The parallel rotary internal combustion engine of claim 1, further comprising a wiper seal with a means to limit movement of said wiper seal, in which said wiper seal is located at the leading base and trailing base of said combustion chamber, and at the leading tip and trailing tip of said at least one lobe.

* * * * *